US012228006B1

(12) United States Patent
Alaithan et al.

(10) Patent No.: US 12,228,006 B1
(45) Date of Patent: Feb. 18, 2025

(54) INTEGRATED VALVE BLOWOUT PREVENTER FOR RIG-LESS WELL INTERVENTIONS

(71) Applicant: SAUDI ARABIAN OIL COMPANY, Dhahran (SA)

(72) Inventors: Ali Naji Alaithan, Umran (SA); James Ohioma Arukhe, Dhahran (SA); Rayed Mohammed Al-Zayer, Tarout (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/425,470

(22) Filed: Jan. 29, 2024

(51) Int. Cl.
*E21B 33/06* (2006.01)

(52) U.S. Cl.
CPC ..... *E21B 33/063* (2013.01); *E21B 2200/04* (2020.05); *E21B 2200/05* (2020.05)

(58) Field of Classification Search
CPC .... E21B 33/063; E21B 34/14; E21B 2200/04; E21B 2200/05
See application file for complete search history.

(56) References Cited

U.S. PATENT DOCUMENTS 3,967,647 A * 7/1976 Young ..... E21B 29/04 166/368
4,044,988 A * 8/1977 Arzumanov ..... E21B 33/062 251/1.3
7,347,261 B2 * 3/2008 Markel ..... E21B 47/092 166/66.5
7,806,103 B2 10/2010 Torii
8,464,795 B2 6/2013 Dyson et al.
8,613,323 B2 * 12/2013 Garbett ..... E21B 33/0353 166/344
10,428,621 B2 * 10/2019 Purkis ..... E21B 34/08
11,396,784 B2 * 7/2022 Szpunar ..... E21B 34/045
2003/0213597 A1 11/2003 Winkle et al.
2004/0107991 A1 6/2004 Hollister et al.
(Continued)

FOREIGN PATENT DOCUMENTS

CN 116733410 A 9/2023
GB 2402409 A 12/2004
WO 2012078780 A2 6/2012

*Primary Examiner* — Aaron L Lembo
(74) *Attorney, Agent, or Firm* — Osha Bergman Watanabe & Burton LLP

(57) ABSTRACT

A system performs rig-less well intervention at wellbore. The system includes a wellhead provided at a wellbore and a flow regulation device that selectively admits a flow of formation fluid between the wellhead and the blowout preventer. The system further includes a shifting tool mechanism configured to latch on and engage the flow regulation device to selectively control the flow of formation fluid between the wellhead and the blowout preventer. A related method includes connecting a rig-less well intervention unit to a blowout preventer and connecting the blowout preventer to a Christmas tree. The blowout preventer comprises a shifting tool mechanism and the Christmas tree comprises a flow regulation device. The method further includes lowering the shifting tool mechanism to a predetermined depth, engaging the shifting tool mechanism with the flow regulation device and activating the shifting tool mechanism to actuate the flow regulation device to an open position.

20 Claims, 7 Drawing Sheets

(56) References Cited

U.S. PATENT DOCUMENTS

| | | | | |
|---|---|---|---|---|
| 2008/0135235 | A1* | 6/2008 | McCalvin | E21B 34/06<br>166/250.01 |
| 2008/0277122 | A1* | 11/2008 | Tinnen | E21B 23/14<br>166/339 |
| 2013/0043044 | A1* | 2/2013 | Garber | E21B 21/106<br>166/325 |
| 2015/0136406 | A1* | 5/2015 | Baez | E21B 23/04<br>166/335 |
| 2024/0003224 | A1* | 1/2024 | Alssamen | E21B 33/06 |

* cited by examiner

INTEGRATED VALVE BLOWOUT PREVENTER FOR RIG-LESS WELL INTERVENTIONS

BACKGROUND

In the petroleum industry, wells are drilled into the surface of the Earth to access and produce hydrocarbons. The process of building a well is often split into two parts: drilling and completion. Drilling a well may include using a drilling rig to drill a hole into the ground, trip in at least one string of casing, and cement the casing string in place. Once the well is producing, well intervention might be required to restore or increase production. A well intervention is mainly due to one of the following: mechanical failure, changes in the characteristics of the reservoir and accessing additional pay zones. There are two types of well interventions conventional workover rig interventions (heavy) and rig-less well interventions (light). Conventional workover interventions usually involve the use of a derrick and the removal of a wellhead.

Rig-less well interventions of various types do not require wellhead removal and include coiled tubing, wireline, and hydraulic workovers. A coiled tubing workover involves inserting a flexible and pressure resistant high-strength steel tubing into a wellbore. A wireline workover involves inserting a tool attached to a small diameter wire into a wellbore to perform various workover operations. A hydraulic workover involves hydraulic cylinders and connected piping where the hydraulic cylinders push the connected piping into the wellbore. In most rig-less well interventions, a tree cap is removed and a blowout preventer (BOP) is attached to a Christmas tree to perform a workover. Tree cap removal can be time consuming and challenging for a variety of reasons, especially if the tree cap is stuck and does not move.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to systems and methods for use during rig-less well interventions in a wellbore. In one or more embodiments, the system includes a wellhead provided at a wellbore, a blowout preventer in fluid communication with the wellhead, a flow regulation device and a shifting tool mechanism that engages the flow regulation device to control the flow of formation fluid. The shifting tool mechanism is housed in bottom end of the blowout preventer and the regulation device is housed in the top end of the Christmas tree. The shifting tool mechanism may be lowered to required depth at which it may mechanically engage the flow regulation device to selectively actuate it to an open or a close position.

This disclosure presents, in accordance with one or more embodiments, a system for use during rig-less well interventions in a wellbore. The system includes a wellhead provided at a wellbore, a blowout preventer in fluid communication with the wellhead, a flow regulation device and a shifting tool mechanism that engages the flow regulation device to control the flow of formation fluid. The shifting tool mechanism and the flow regulation device are housed in the bottom end of the blowout preventer. The shifting tool mechanism may be lowered to required depth at which it may mechanically engage the flow regulation device to selectively actuate it to an open or a close position.

This disclosure presents, in accordance with one or more embodiments a system for use during rig-less well interventions in a wellbore. The system includes a wellhead provided at a wellbore, a blowout preventer in fluid communication with the wellhead, a flow regulation device and a shifting tool mechanism that engages the flow regulation device to control the flow of formation fluid. The shifting tool mechanism and the flow regulation device are housed in a joint. The joint is connected to the Christmas tree and the blowout preventer. The shifting tool mechanism may be lowered to required depth at which it may mechanically engage the flow regulation device to selectively actuate it to an open or a close position.

This disclosure presents, in accordance with one or more embodiments, a system for use during rig-less well interventions in a wellbore. The system includes a wellhead provided at a wellbore, a blowout preventer in fluid communication with the wellhead, a flow regulation device and a shifting tool mechanism that engages the flow regulation device to control the flow of formation fluid. The shifting tool mechanism and the flow regulation device are housed in top end of the Christmas tree. The shifting tool mechanism may be lowered to required depth at which it may mechanically engage the flow regulation device to selectively actuate it to an open or a close position.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
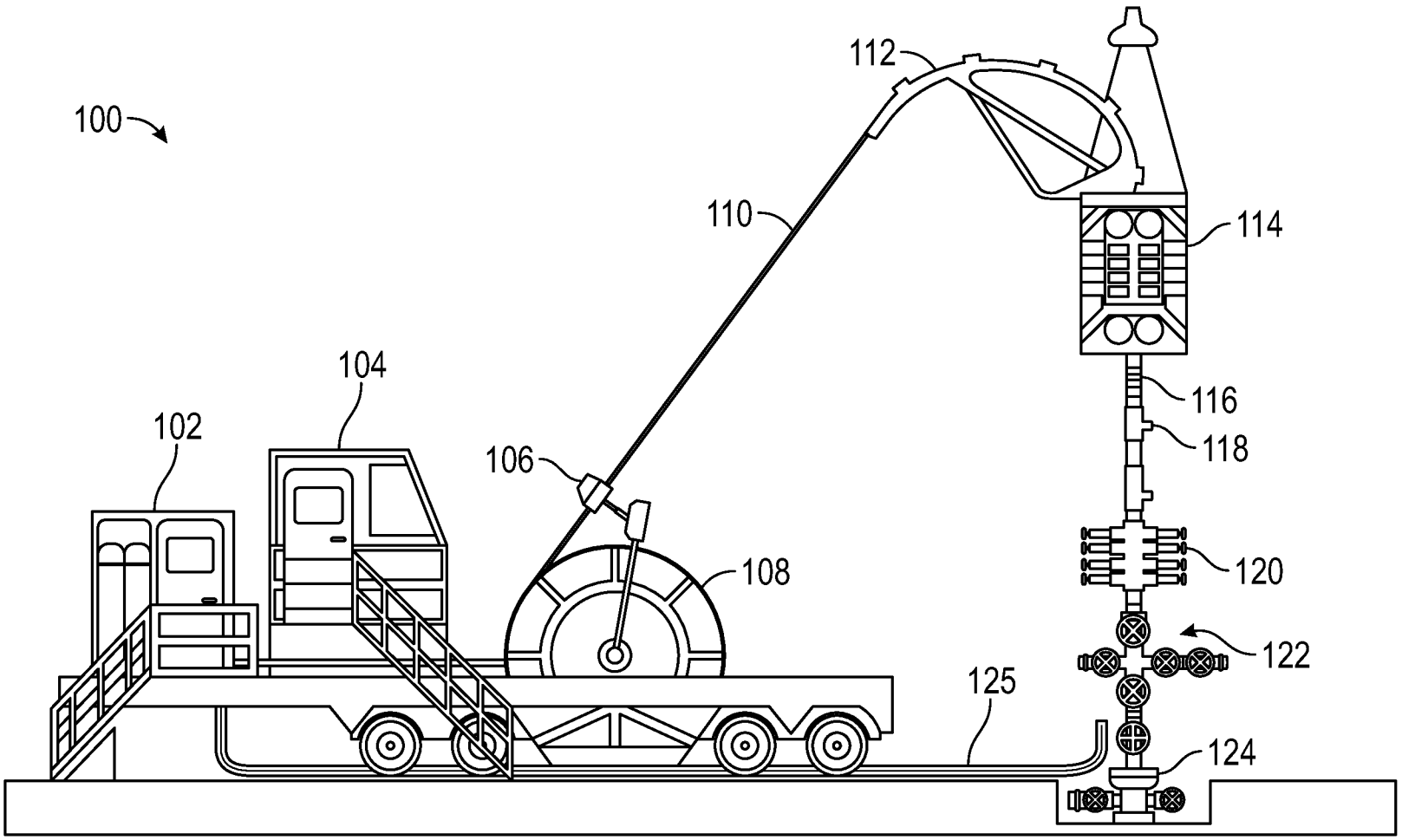
FIG. 1 schematically illustrates, in cross-sectional elevational view, a rig-less well intervention system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

By way of general background in accordance with one or more embodiments, after a wellbore has been drilled and cemented at a well site, production activities start. This involves installing various equipment and production tubing to facilitates and maximize hydrocarbons extraction. Over time, a well may mature, which may result in a decline in the production rate due to various problems that include reservoir related issues. Acid simulation or well fracturing may be used to increase or restore production rate to previous levels. Alternatively, a decline or a stop in production may be the result of an equipment malfunction. Rig-less well interventions, such as those involving coiled tubing or a slickline, may be used to perform remedial work on a well, such as well head maintenance.

In performing a rig-less well intervention conventionally, a specialized blowout preventer (BOP) may be connected to a Christmas tree. However, first the tree cap must normally be removed to permit fluid communication between the BOP and Christmas tree. There are multiple scenarios that could prevent the full removal of a tree cap. Such scenarios include a tree cap clogged up by solid hydrates. Such solid hydrates may be solid structures that can form under high pressure and low temperatures, often encountered in subsea oil and gas operations. In such a scenario, the solid hydrates accumulate on the tree cap and subsequently block access and prevent its removal. Additional potential scenarios that can prevent the full removal of a tree cap include thread damage on the tree cap or its mating surface on the Christmas tree and improper tree cap installation. In such scenarios, specialized tools and techniques may be used in conjunction with well intervention and removal procedures, but may also involve significant monetary costs and expenditures of time. Thus, it will be appreciated in view of the description below that this and other clear disadvantages of conventional arrangements are wholly circumvented and obviated via key features of one or more embodiments as described.

As such, FIG. 1 schematically illustrates, in cross-sectional elevational view, a coiled tubing unit (100) connected to a blowout preventer (BOP) (120) in accordance with one or more embodiments. The coiled tubing unit (100) of FIG. 1 includes coiled tubing (110), a coiled tubing reel (108), a gooseneck (112), an injector head (114), a slide door stripper (116) and a lubricator (118). The coiled tubing reel (108), having a spooler head (106), is a reel that holds the coiled tubing (110) and may allow a regulated insertion or retrieval of coiled tubing (110) in and out of the well. Coiled tubing (110) may be formed from steel and have flexible material characteristics. The gooseneck (112) is a guide arch that guides the coiled tubing (110) from the coiled tubing reel (108) to an injector head (114). The injector head (114) may grip and provide a tractive force to execute the insertion and retrieval of coiled tubing (110). The slide door stripper (116) is connected to the injector head and may allow the movement of the coiled tubing (110). The lubricator (118) is connected to the slide door stripper (116) and may lubricate the coiled tubing (110) during its movement.

In accordance with one or more embodiments, the coiled tubing unit (100) may further include a control cabin (104), hydraulics (125), and a power pack and accumulator unit (102). The control cabin (104) may include a control panel that controls different parameters such as speed of the coiled tubing (110). The hydraulics (125) are connected to multiple components including the control cabin (104), the power back and accumulator unit (102) and the BOP (120). The power pack and accumulator unit (102) energize the coiled tubing unit (100).

In accordance with one or more embodiments, FIG. 1 further depicts the BOP (120) connected to a Christmas tree (122). In accordance with at least one variant, the BOP (120) and the Christmas tree (122) may have different interface specifications and connection types therefore an adapter flange may be utilized to connect the BOP (120) to a Christmas tree (122). The BOP (120) is mainly utilized as a safety system to prevent any uncontrolled fluid release. In accordance with at least one variant, the Christmas tree (122) may include a gate valve that selectively admits a flow of formation fluid from the wellbore. The Christmas tree (122) is connected to the wellhead (124), which in turn is provided at a well. Both the BOP (120) and the Christmas tree (122) may be part of the infrastructure of well intervention activities. In accordance with at least one variant, the BOP (120) may be formed from a steel alloy.

Figure 2:
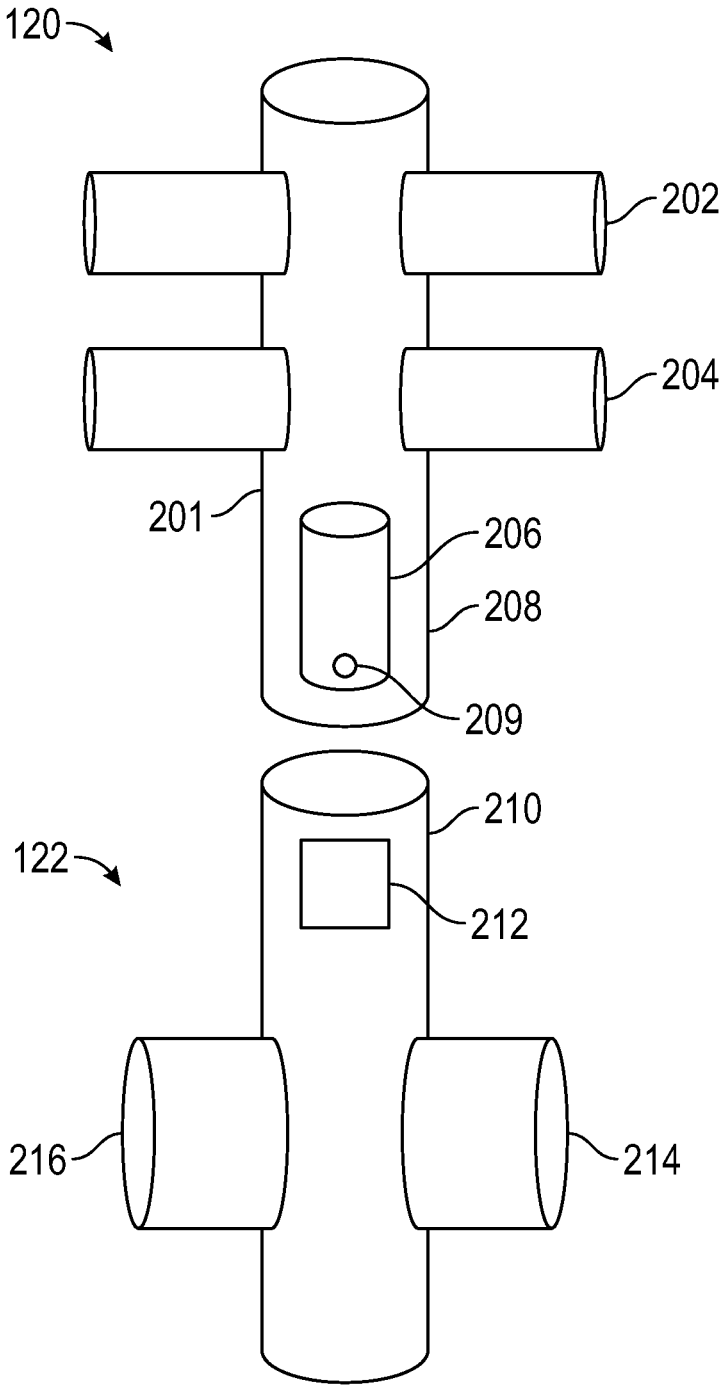
FIG. 2 schematically illustrates a closeup, cross-sectional elevational view of the blowout preventer and Christmas tree of FIG. 1 in accordance with one or more embodiments.

In accordance with one or more embodiments, FIG. 2 schematically illustrates a close-up, cross-sectional elevational view of the Christmas tree (122) connected to the BOP (120) of FIG. 1. The Christmas tree (122) includes a kill wing (216), a production wing (214) and a flow regulation device (212). The flow regulation device (212) is housed in an upper section of a Christmas tree (210). The flow regulation device (212) may be configured to be latched on by a shifting tool mechanism (206). The flow regulation device (212), merely by way of illustrative and non-restrictive example, may be a flapper valve or a ball valve. The BOP (120) includes a lower ram (204), an upper ram (202) and a body (201). In accordance with at least one variant, the shifting tool mechanism (206) may be mounted in the body (201) of the BOP (120). The lower section of the BOP (208) may house the shifting tool mechanism (206). The function of the upper and lower ram (202, 204) may be to secure the well by closing around coiled tubing (110) and stopping a flow of fluids. In accordance with at least one variant, the BOP (120) may additionally include shear rams configured to shear the coiled tubing (110). The shifting tool mechanism (206) is housed in the of the BOP (208).

In accordance with one or more embodiments, once the BOP (120) is connected to the Christmas Tree, the shifting tool mechanism (206) is lowered to latch on the flow regulation device (212) and exert a force to open the flow regulation device (212) and allow passage of the coiled tubing (110). Activation and control of the shifting tool mechanism (206) may be mechanical, hydraulic, or electronic. In the case of a ball valve, the shifting tool mechanism (206) may latch onto (or engage with) the ball valve, and rotate the same to open or close it. In the case of a flapper valve, the shifting tool mechanism (206) can exert an upward or downward force to pivot a flapper into an opened or a closed position. Once a coiled tubing attachment or a wireline attachment is lowered beyond the flow regulation device (212) and into the well, the BOP (120) closes to maintain well control and avoid any inadvertent influx of hydrocarbons (or of any other fluids) from the wellbore.

In accordance with one or more embodiments, the shifting tool mechanism (206) may be made of one or more corrosion-resistant materials, such as stainless steel, and may be coated to increase corrosion resistivity and decrease friction. The flow regulation device (212) maybe be mainly made from one or more corrosion-resistant material, such as stainless steel and may be coated to increase corrosion resistance. Additionally, the flow regulation device (212) may have one or more seals made of rubber such as nitrile due to its resistance to hydrocarbons.

In accordance with one or more embodiments, the shifting tool mechanism (206) may comprise a sensor (209) configured to monitor the position of the flow regulation device (212) to the shifting tool mechanism (206). Once the sensor (209) monitors and confirms the shifting tool mechanism (206) is at an optimal position to latch on to the flow regulation device (212), the decent of the shifting tool mechanism (206) is halted and the latch on mechanism is actuated. Additionally, the sensor (209) is configured to confirm the status of the position of flow regulation device (212).

In accordance with one or more embodiments, as will be further appreciated below, a BOP (120) connected to a Christmas tree (122) and having a shifting tool mechanism (206) configured to engage with a flow regulation device (212), permits connecting a rig-less well intervention unit to Christmas tree (122) without the risk of complications associated with a Christmas tree cap, such as the cap getting stuck.

As such, and as will be further appreciated in view of the description below, embodiments contemplated herein provide for systems that include a shifting tool mechanism (206) and a flow regulation device (212) for performing rig-less well intervention that may be put in place for rig-less well intervention workovers, without the potential of a tree cap getting stuck and requiring remedial work.

Figure 3:
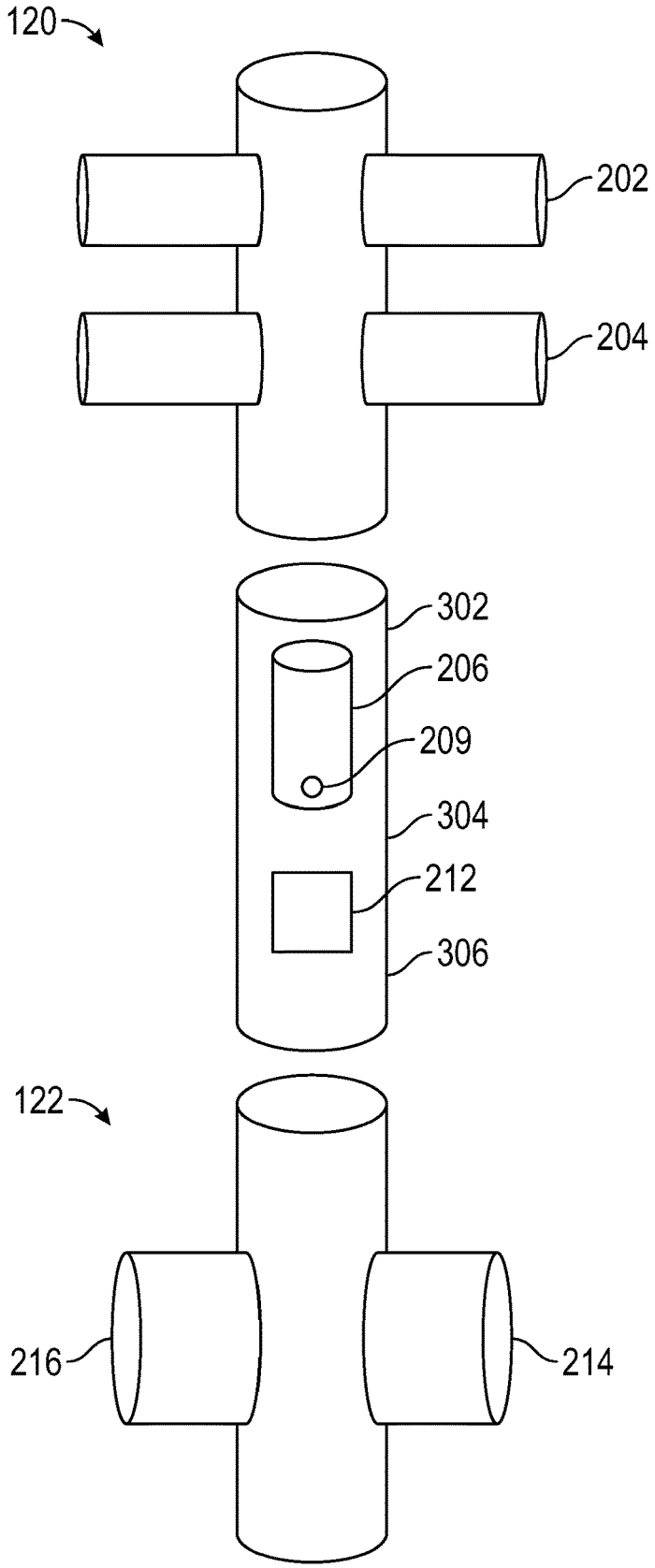
FIG. 3 shows an arrangement in which the shifting tool mechanism and flow regulation device are housed in a joint, in accordance with one or more embodiments.
Figure 4:
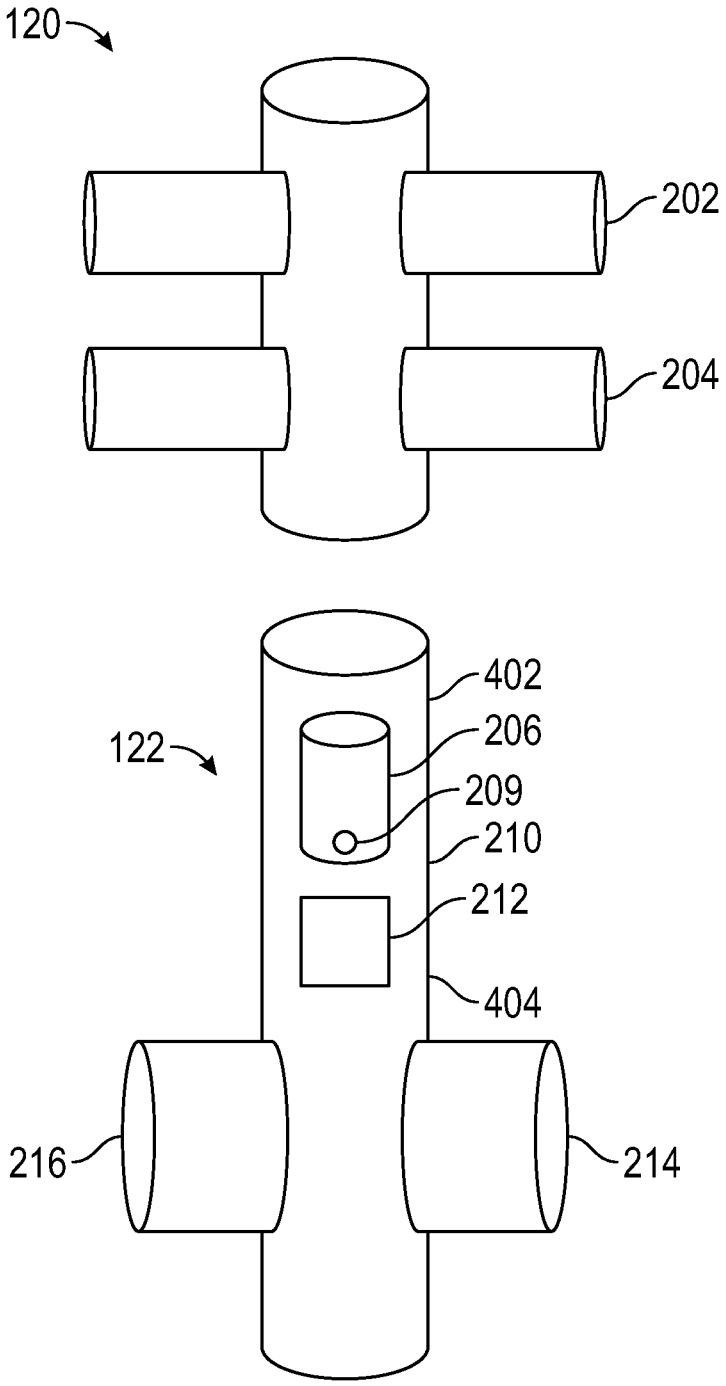
FIG. 4 shows an arrangement in which the shifting tool mechanism and flow regulation device are housed in the Christmas tree, in accordance with one or more embodiments.

Accordingly, FIGS. 3-4 each provide a similar view as FIG. 2 but show variant arrangements of systems that include a shifting tool mechanism (206) and a flow regulation device (212) for performing rig less well intervention, in accordance with one or more embodiments. For general purposes of readability, components shown in FIGS. 3-4 that are the same or similar to components shown in FIGS. 1-2 can be understood as having essentially the same description and function as set forth above, beyond any additional description provided below.

In accordance with one or more embodiments, FIG. 3 shows an arrangement in which the shifting tool mechanism (206) and the flow regulation device (212) are housed in a joint (304) that connects the BOP (120) to the Christmas tree (122). The shifting tool mechanism (206) may be housed in the upper section of the joint (302) and the flow regulation device (212) may be housed in a lower section of the joint (306). The flow regulation device (212) may be configured to be latched onto by a shifting tool mechanism (206), as discussed heretofore. The flow regulation device (212) is a flow control device that can be in an open position, which allows fluid to flow from the Christmas tree (122) to the BOP (120), or to lower coiled tubing (110) from the BOP (120) to the Christmas tree (122) and into the well. Additionally, the flow regulation device (212) may be in a closed position which blocks the flow of fluids in both the uphole and downhole directions. Moreover, the flow regulation device (212) may be set to a position that is physically between the open and closed positions; this may be done to tailor the flow of fluid with some precision and may even serve as a backup to BOP (120). As discussed above, the flow regulation device (212) may be embodied by any of a variety of arrangements, such as a flapper valve or a ball valve.

In accordance with one or more embodiments, once the BOP (120) and the Christmas tree (122) are connected with the joint (304), the shifting tool mechanism (206) and flow regulation device (212) may function substantially as described heretofore in connection with FIG. 2.

In accordance with one or more embodiments, the shifting tool mechanism (206) may comprise a sensor (209) and may function substantially as described heretofore in connection with FIG. 2.

In accordance with one or more embodiments, the joint (304), housing the shifting tool mechanism (206) and the flow regulation device (212), may replace a tree cap of the Christmas tree (122).

In accordance with one or more embodiments, the joint (304) may house an alternation of a plurality of shifting tool mechanisms (206) and a plurality of flow regulation devices (212) connected in series. For instance, there may be two shifting tool mechanisms (206) and two flow regulation devices (212), or three shifting tool mechanisms (206) and flow regulation devices (212), wherein the shifting tool mechanisms (206) and flow regulation devices (212) alternate in series along an axial direction of the joint (304).

In accordance with one or more embodiments, FIG. 4 provides essentially the same view as FIG. 2, wherein the shifting tool mechanism (206) and flow regulation device (212) are both housed in the upper section of the Christmas tree (210). The shifting tool mechanism (206) may be housed in the top of the upper section of the Christmas tree (402) and the flow regulation device (212) may be housed in the bottom of the upper section of the Christmas tree (404). Accordingly, the sensor (209) of the shifting tool mechanism (206) may be configured, and may function, in similar fashion as discussed with respect to FIGS. 2-3. Additionally, the shifting tool mechanism (206) and flow regulation device (212) may be configured, and may function, in similar fashion as discussed with respect to FIGS. 2-3.

In accordance with one or more embodiments, the Christmas tree (122) may house an alternation of a plurality of shifting tool mechanisms (206) and a plurality of flow regulation devices (212) connected in series. For instance, there may be two shifting tool mechanisms (206) and two flow regulation devices (212), or three shifting tool mechanisms (206) and flow regulation devices (212), wherein the shifting tool mechanisms (206) and flow regulation devices (212) alternate in series along an axial direction of the Christmas tree (122).

Figure 5B:
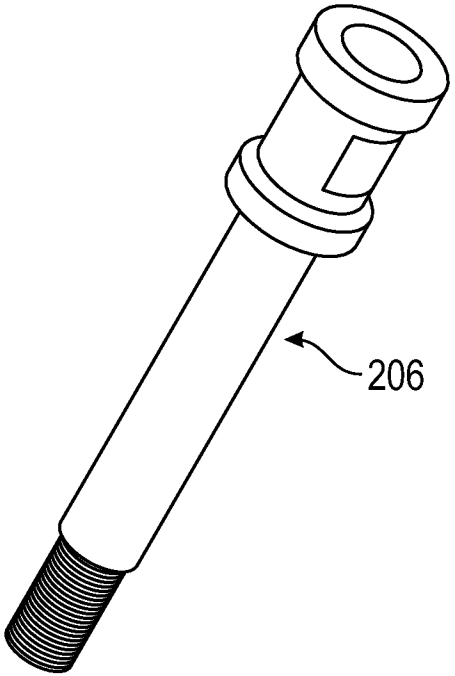
FIG. 5B shows the shifting tool mechanism of FIG. 5A in assembled form, in accordance with one or more embodiments.
Figure 5A:
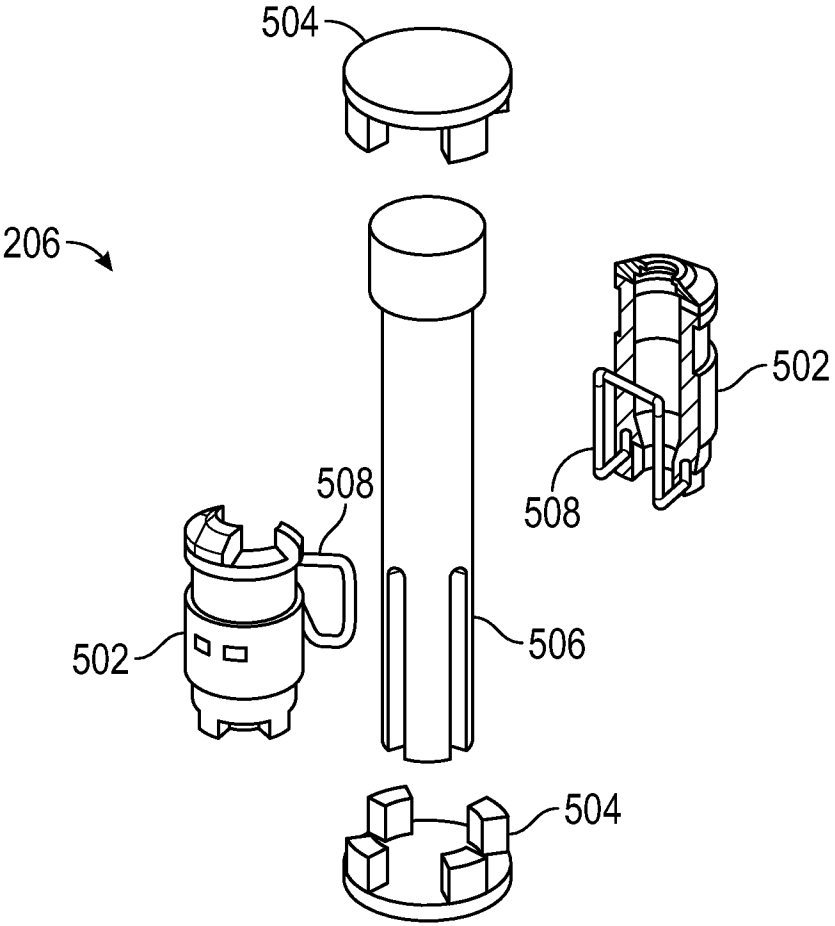
FIG. 5A shows the main parts of a shifting tool mechanism in exploded isometric view, in accordance with one or more embodiments.

In accordance with one or more embodiments, FIG. 5A depicts a shifting tool mechanism (206) that includes a pair of cooperating keys (502) that each include a key spring (508), and a pair of cooperating tabs (504). The shifting tool mechanism (206) may include a gripping mechanism embodied by a collet (506). The collet (506) is an elongated, generally cylindrical component that includes an uppermost, larger cylindrical portion and a lowermost portion that includes a plurality of fingers that are separated by axially-oriented slots. The lowermost portion, via the fingers, may be configured to expand and contract radially to grip an inner or outer surface of at least a portion of a flow regulation device (such as a ball valve or flapper valve); this represents the process of "latching on" to a flow regulation device as discussed herein.

In accordance with one or more embodiments, the keys (502) may be generally semi-cylindrical in shape and may cooperate to engage with each other radially, and directly about an external surface of the uppermost portion of collet (506). The keys (502) are configured to facilitate a secure process of latching on to a flow regulation device to avoid slippage or misalignment of the collet (506). In this connection, the keys (502) may engage with one or more adjacent structural features such as a slot or recess, to permit the entire shifting tool mechanism (206) to be held in place and to permit the collet (506) to then move freely in an axial direction to facilitate the aforementioned latching-on process. The tabs (504), for their part, may cooperate to engage with each other axially, at opposing axial sides of the uppermost portion of collet (506); essentially, the tabs (504), of generally larger diameter than the shifting tool mechanism (206), can aid in aligning the shifting tool mechanism (206) as it is inserted into a BOP (120), joint (304) or Christmas tree (122) (see FIGS. 2-4). Essentially, in accordance with at least one working example, the key springs (508) may be regarded as spring mechanisms that apply a biasing force to the keys (502), directed radially inwardly, to ensure the keys (502) successfully retract radially inwardly after actuation (e.g., after engaging with the one or more adjacent structural features as just mentioned). The points where force is applied to the shifting tool mechanism (206) to engage or disengage the collet (506) or to turn the keys (502) may be denoted as force application points.

In accordance with one or more embodiments, FIG. 5B shows the shifting tool mechanism (206) of FIG. 5A in assembled form.

In accordance with one or more embodiments, once the BOP (120) is connected to the Christmas Tree, the shifting tool mechanism (206) may be lowered to a predetermined optimal depth at which the shifting tool mechanism (206) is capable of engaging the profile of a flow regulation device (such as a ball valve or flapper valve). In the case of a ball valve, the shifting tool mechanism's collet (506) and keys (502) may engage with the ball valve's stem or a dedicated interface on the ball valve body, allowing rotation to open or close the valve. In the case of a flapper valve, the shifting tool mechanism (206) may exert an upward or downward force to pivot a flapper into an opened or a closed position.

Figure 6:
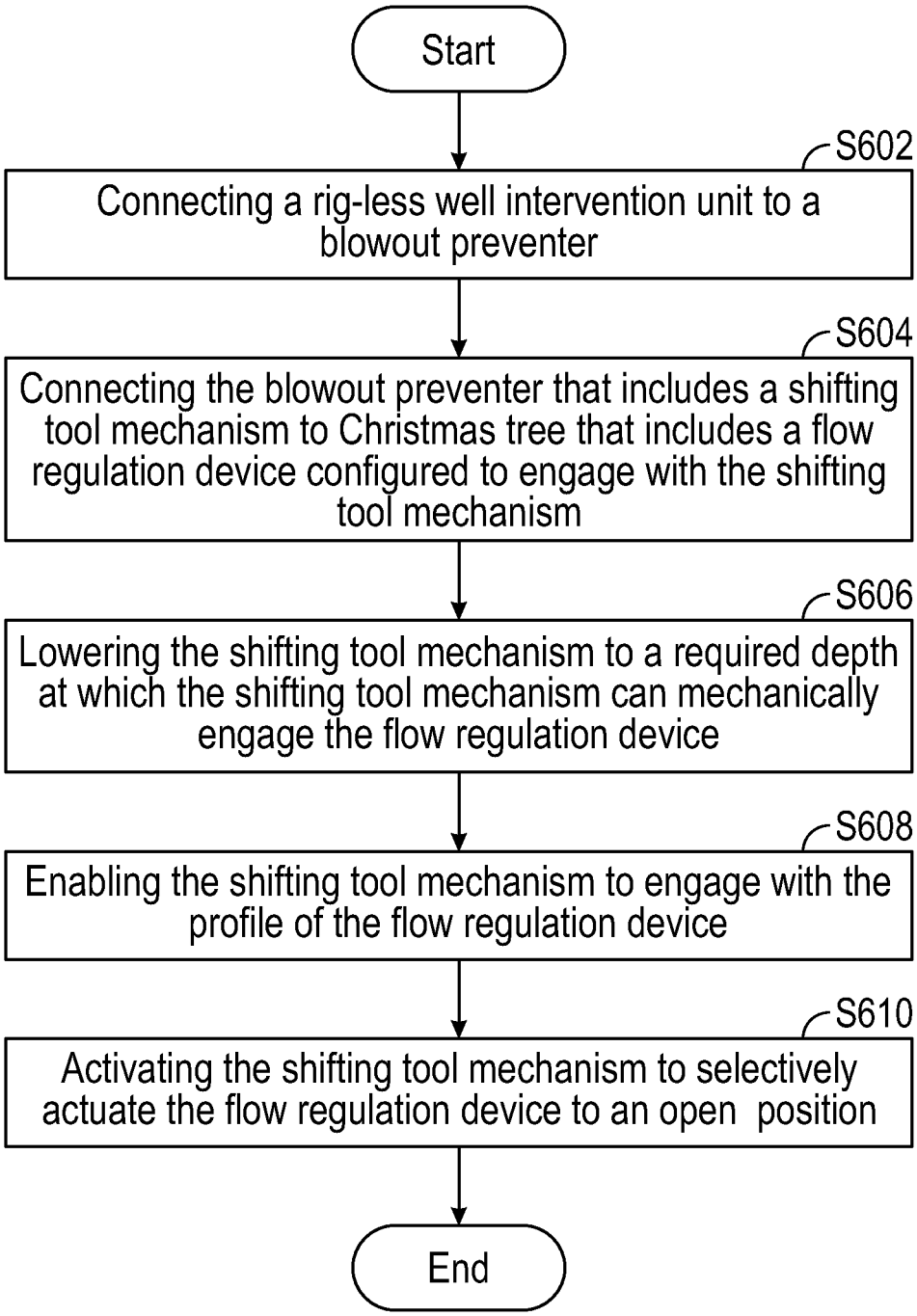
FIG. 6 shows a flowchart of a method in accordance with one or more embodiments.

In accordance with one or more embodiments, FIG. 6 depicts a flowchart in accordance with one or more embodiments. More specifically, FIG. 6 illustrates a method for performing rig-less well intervention while using a system that includes a shifting tool mechanism (206) and a flow regulation device (212). Further, one or more blocks in FIG. 6 may be performed by one or more components as described in FIGS. 1-5B. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Thus, in accordance with one or more embodiments, in step 602, a rig-less well intervention unit is connected to a blowout preventer. In step 604, a blowout preventer (120) comprising a shifting tool mechanism (206) may be connected to a Christmas tree (122) comprising a flow regulation device (212). In step 606, the shifting tool mechanism (206) is lowered to a required depth at which the shifting tool mechanism (206) may engage the flow regulation device (212). In step 608, the shifting tool mechanism (206) may engage a profile of the flow regulation device (212). In step 610, activating the shifting tool mechanism (206) to selectively actuate the flow regulation device (212) to an open position.

Figure 7:
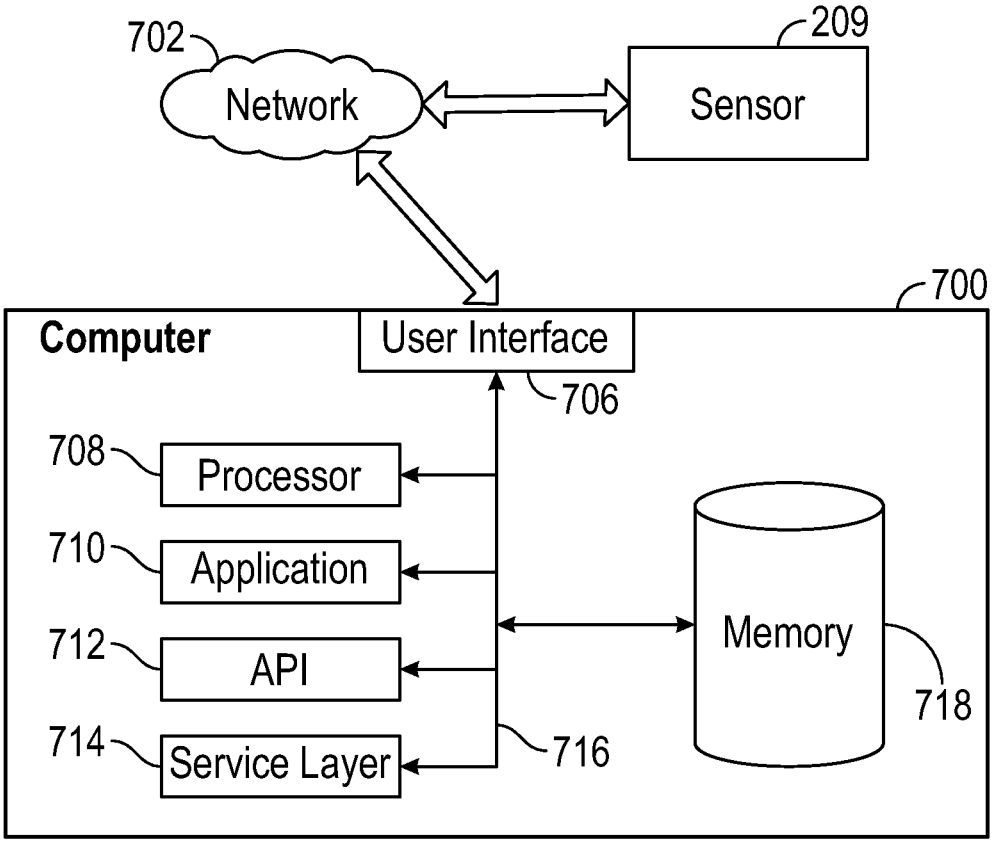
FIG. 7 schematically illustrates a computing device and related components, in accordance with one or more embodiments.

In accordance with one or more embodiments, FIG. 7 shows a computer (700) in communication with a sensor (209) disposed on a shifting tool mechanism (206) (see FIGS. 2-4). The sensor (209) may have an antenna to send and receive data. The communication may occur over a network (702) that may be a local area network using an ethernet or Wi-Fi system, or alternatively the network (702) may be a wide area network using an internet or intranet service. Alternatively, the communication may be transmitted over a network (702) using satellite communication networks.

As such, in accordance with one or more embodiments, FIG. 7 further depicts a block diagram of a computer (700) used to provide computational functionalities associated with described algorithms, methods, functions, processes, flows, and procedures as described in this disclosure, according to one or more embodiments. The illustrated computer (700) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (700) may include a computer that includes an input device, such as a keypad, keyboard, touch screen, or other device that can accept user information, and an output device that conveys information associated with the operation of the computer (700), including digital data, visual, or audio information (or a combination of information), or a GUI.

The computer (700) can serve in a role as a client, network component, a server, a database or other persistency, or any other component (or a combination of roles) of a computer system for performing the subject matter described in the instant disclosure. The illustrated computer (700) is communicably coupled with a network (702). In some implementations, one or more components of the computer (700) may be configured to operate within environments, including cloud-computing-based, local, global, or other environment (or a combination of environments).

At a high level, the computer (700) is an electronic computing device operable to receive, transmit, process, store, or manage data and information associated with the described subject matter. According to some implementations, the computer (700) may also include or be communicably coupled with an application server, e-mail server, web server, caching server, streaming data server, business intelligence (BI) server, or other server (or a combination of servers).

The computer (700) can receive requests over network (702) from a client application (for example, executing on another computer (700) and responding to the received requests by processing the said requests in an appropriate software application. In addition, requests may also be sent to the computer (700) from internal users (for example, from a command console or by other appropriate access method), external or third-parties, other automated applications, as well as any other appropriate entities, individuals, systems, or computers.

Each of the components of the computer (700) can communicate using a system bus (716). In some implementations, any or all of the components of the computer (700), both hardware or software (or a combination of hardware and software), may interface with each other or the user interface (706) (or a combination of both) over the system bus (716) using an application programming interface (API) (712) or a service layer (714) (or a combination of the API (712) and service layer (714). The API (712) may include specifications for routines, data structures, and object classes. The API (712) may be either computer-language independent or dependent and refer to a complete interface, a single function, or even a set of APIs. The service layer (714) provides software services to the computer (700) or other components (whether or not illustrated) that are communicably coupled to the computer (700). The functionality of the computer (700) may be accessible for all service consumers using this service layer. Software services, such as those provided by the service layer (714), provide reusable, defined business functionalities through a defined interface. For example, the interface may be software written in JAVA, C++, or other suitable language providing data in extensible markup language (XML) format or another suitable format. While illustrated as an integrated component of the computer (700), alternative implementations may illustrate the API (712) or the service layer (714) as standalone components in relation to other components of the computer (700) or other components (whether or not illustrated) that are communicably coupled to the computer (700). Moreover, any or all parts of the API (712) or the service layer (714) may be implemented as child or submodules of another software module, enterprise application, or hardware module without departing from the scope of this disclosure.

The computer (700) includes a user interface (706). Although illustrated as a single user interface (706) in FIG. 7, two or more user interfaces (706) may be used according to particular needs, desires, or particular implementations of the computer (700). The user interface (706) is used by the computer (700) for communicating with other systems in a distributed environment that are connected to the network (702). Generally, the user interface (706) includes logic encoded in software or hardware (or a combination of software and hardware) and operable to communicate with the network (702). More specifically, the user interface (706) may include software supporting one or more communication protocols associated with communications such that the network (702) or interface's hardware is operable to communicate physical signals within and outside of the illustrated computer (700).

The computer (700) includes at least one computer processor (708). Although illustrated as a single computer processor (708) in FIG. 7, two or more processors may be used according to particular needs, desires, or particular implementations of the computer (700). Generally, the computer processor (708) executes instructions and manipulates data to perform the operations of the computer (700) and any algorithms, methods, functions, processes, flows, and procedures as described in the instant disclosure.

The computer (700) also includes a memory (718) that holds data for the computer (700) or other components (or a combination of both) that can be connected to the network (702). For example, memory (718) can be a database storing data consistent with this disclosure. Although illustrated as a single memory (718) in FIG. 7, two or more memories may be used according to particular needs, desires, or particular implementations of the computer (700) and the described functionality. While memory (718) is illustrated as an integral component of the computer (700), in alternative implementations, memory (718) can be external to the computer (700).

The application (710) is an algorithmic software engine providing functionality according to particular needs, desires, or particular implementations of the computer (700), particularly with respect to functionality described in this disclosure. For example, application (710) can serve as one or more components, modules, applications, etc. Further, although illustrated as a single application (710), the application (710) may be implemented as multiple applications (710) on the computer (700). In addition, although illustrated as integral to the computer (700), in alternative implementations, the application (710) can be external to the computer (700).

There may be any number of computers (700) associated with, or external to, a computer system containing computer (700), wherein each computer (700) communicates over network (702). Further, the term "client," "user," and other appropriate terminology may be used interchangeably as appropriate without departing from the scope of this disclosure. Moreover, this disclosure contemplates that many users may use one computer (700), or that one user may use multiple computers (700).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for rig-less well intervention, the system comprising:

a wellhead provided at a wellbore;

a blowout preventer in fluid communication with the wellhead;

a flow regulation device that selectively admits a flow of formation fluid between the wellhead and the blowout preventer; and a shifting tool mechanism configured to latch on and engage the flow regulation device to selectively control the flow of formation fluid between the wellhead and the blowout preventer, wherein the blowout preventer comprises a body, and the shifting tool mechanism is mounted in the body.

2. The system of claim 1, wherein the flow regulation device comprises a valve that is engaged by the shifting tool mechanism to selectively actuate into an open position or into a closed position.

3. The system of claim 2, wherein the valve is a flapper valve comprising a flapper that pivots between an open position and a closed position.

4. The system of claim 2, wherein the valve is a ball valve comprising a ball that rotates between the open position and the closed position.

5. The system of claim 1, further comprising a coiled tubing unit connected to the blowout preventer.

6. The system of claim 1, further comprising a slickline unit connected to the blowout preventer.

7. The system of claim 1, further comprising a Christmas tree in fluid communication with the wellhead and the blowout preventer, the Christmas tree including a gate valve that selectively admits a flow of formation fluid from the wellbore.

8. The system of claim 7, wherein the blowout preventer is connected to Christmas tree via an adapter flange.

9. The system of claim 8, wherein the flow regulation device is housed in the Christmas tree between the adapter flange and the gate valve.

10. The system of claim 1, wherein the shifting tool mechanism comprises a sensor configured to monitor a position of the flow regulation device.

11. The system of claim 1, wherein the body of the blowout preventer is formed from a steel alloy.

12. The system of claim 1, wherein the blowout preventer further comprises shear rams configured to shear tubing.

13. The system of claim 1, wherein the blowout preventer further comprises shear rams configured to shear one or more slicklines.

14. A method for performing rig-less well intervention, the method comprising:

connecting a rig-less well intervention unit to a blowout preventer;

connecting the blowout preventer to a Christmas tree;

wherein the blowout preventer comprises a body and a shifting tool mechanism housed in a lower section of the blowout preventer, and wherein the Christmas tree comprises a flow regulation device that includes a profile and is configured to engage with the shifting tool mechanism;

lowering the shifting tool mechanism to a predetermined depth;

wherein the predetermined depth is a depth at which the shifting tool mechanism is capable of engaging a profile of the flow regulation device;

engaging the shifting tool mechanism with the flow regulation device; and activating the shifting tool mechanism to actuate the flow regulation device to an open position.

15. The method of claim 14, wherein the rig-less well intervention unit is a coiled tubing unit.

16. The method of claim 14, wherein the rig-less well intervention unit is a slickline unit.

17. The method of claim 14, wherein the blowout preventer is connected to the Christmas tree via an adapter flange.

18. The method of claim 14, further comprising:

lowering the shifting tool mechanism to the predetermined depth;

engaging the shifting tool mechanism with the flow regulation device; and activating the shifting tool mechanism to actuate the flow regulation device to a closed position.

19. The method of claim 14, wherein activating the shifting tool mechanism to actuate the flow regulation devices includes applying a force on the flow regulation device.

20. A system for rig-less well intervention, the system comprising:

a wellhead provided at a wellbore;

a blowout preventer in fluid communication with the wellhead;

a flow regulation device that selectively admits a flow of formation fluid between the wellhead and the blowout preventer;

a shifting tool mechanism configured to latch on and engage the flow regulation device to selectively control the flow of formation fluid between the wellhead and the blowout preventer;

a Christmas tree in fluid communication with the wellhead; and a joint in fluid communication with the Christmas tree and the blowout preventer;

wherein the joint houses the shifting tool mechanism and the flow regulation device.

* * * * *